US009513075B2

(12) United States Patent
Lallier et al.

(10) Patent No.: US 9,513,075 B2
(45) Date of Patent: Dec. 6, 2016

(54) TOY LAUNCH APPARATUS WITH OPEN TOP DART DRUM

(71) Applicant: Hasbro, Inc., Pawtucket, RI (US)

(72) Inventors: John Paul Lallier, North Attleboro, MA (US); David Michael Nugent, Newport, RI (US); Katherine A Mermelstein, East Walpole, MA (US); Tadeusz W Keska, Smithfield, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 14/791,292

(22) Filed: Jul. 3, 2015

(65) Prior Publication Data

US 2016/0018173 A1 Jan. 21, 2016

Related U.S. Application Data

(60) Provisional application No. 62/022,077, filed on Jul. 8, 2014.

(51) Int. Cl.

| | |
|---|---|
| ***F41B 11/54*** | (2013.01) |
| ***F41B 7/08*** | (2006.01) |
| ***F41A 9/73*** | (2006.01) |
| ***F41B 5/12*** | (2006.01) |
| ***F41B 11/89*** | (2013.01) |
| ***F41A 17/30*** | (2006.01) |
| ***F41A 17/46*** | (2006.01) |

(52) U.S. Cl.

CPC ..... *F41A 9/73* (2013.01); *F41A 17/30* (2013.01); *F41A 17/46* (2013.01); *F41B 5/12* (2013.01); *F41B 7/08* (2013.01); *F41B 11/54* (2013.01); *F41B 11/89* (2013.01)

(58) Field of Classification Search

CPC ..... F41B 11/89; F41B 11/54; F41B 5/126; F41B 7/006

USPC ..... 124/17, 25, 25.5, 41.1, 45, 48, 78; 446/473

See application file for complete search history.

(56) References Cited

U.S. PATENT DOCUMENTS

| | | | | |
|---|---|---|---|---|
| 961,511 A | | 6/1910 | Marble | |
| 1,328,929 A | * | 1/1920 | McDaniel | F41B 7/006 124/29 |
| 1,374,757 A | | 4/1921 | Napier | |
| 1,441,975 A | | 1/1923 | Edelin | |

(Continued)

OTHER PUBLICATIONS

"Rads 12 Mod Write-up PETG Barrels, Improved Seal, Slightly Improved Airflow" (PSYK) Aug. 6, 2011.

(Continued)

*Primary Examiner* — Alexander Niconovich
(74) *Attorney, Agent, or Firm* — Perry Hoffman

(57) ABSTRACT

Several embodiments of toy dart launch apparatus are disclosed including two crossbows with stretchable cords, a spring driven apparatus and an apparatus with battery operated rotatable wheels. Each apparatus includes an open top drum for receiving and storing darts. The darts are tubular and formed of soft foam. The drum includes an open outer surface with spaced recesses so that loaded darts are exposed, the darts being received by a spike in each recess. The recesses also include protrusions for restraining the stored darts on the spike, and a platform is mounted in the crossbows to support each dart when the released stretched cord impacts the dart. In the case of a rotating wheel arrangement, there is no need for spikes on drum or a platform.

17 Claims, 14 Drawing Sheets

(56) References Cited

U.S. PATENT DOCUMENTS 1,985,079 A * 12/1934 Conklin ..... F41A 9/24 124/25
2,109,589 A 3/1938 Horwitt et al.
2,375,607 A 5/1945 Wulfert
2,483,752 A 10/1949 Buhl
2,516,341 A * 7/1950 Raffeis ..... F41B 5/12 124/25
2,725,868 A 12/1955 Foster
2,762,356 A 9/1956 Foster
3,014,308 A 12/1961 Parris
3,016,167 A 1/1962 Richards, Jr. et al.
3,017,874 A 1/1962 Gubash
3,116,730 A 1/1964 Tingley
3,717,136 A 2/1973 Gay et al.
3,765,396 A 10/1973 Kienholz et al.
3,774,586 A * 11/1973 Saito ..... F41B 7/08 124/29
3,818,887 A 6/1974 Akiyama et al.
3,913,553 A 10/1975 Braughler et al.
3,968,783 A * 7/1976 Pfotenhauer ..... F41B 7/006 124/25
4,004,566 A 1/1977 Fischer
4,170,215 A 10/1979 Kettlestrings
4,248,202 A 2/1981 Jaworski et al.
4,565,182 A * 1/1986 Barnett ..... F41B 5/12 124/25
4,659,320 A 4/1987 Rich et al.
4,742,812 A * 5/1988 Goodman ..... F41B 5/12 124/25
4,843,751 A 7/1989 Ferri
4,848,307 A * 7/1989 Tsao ..... A63H 27/14 124/59
4,850,328 A 7/1989 Sindel
5,113,842 A 5/1992 Moormann
5,156,137 A * 10/1992 Clayton ..... F41B 7/00 124/27
5,165,383 A 11/1992 Ebert et al.
5,186,156 A 2/1993 Clayton
5,224,464 A * 7/1993 Burnham ..... F41B 7/00 124/16
5,267,549 A 12/1993 Webber
5,282,453 A 2/1994 Chia
5,292,134 A 3/1994 Schlundt et al.
5,377,656 A 1/1995 Lewinski et al.
5,433,646 A 7/1995 Tarng
5,437,260 A * 8/1995 King ..... F41B 5/12 124/25
5,460,150 A 10/1995 Joppe
5,471,967 A * 12/1995 Matsuzaki ..... F41B 4/00 124/47
5,515,837 A 5/1996 Nin et al.
5,517,780 A 5/1996 Haber et al.
5,522,374 A * 6/1996 Clayton ..... F41B 11/54 124/48
5,529,050 A 6/1996 D'Andrade
5,544,641 A * 8/1996 Jenn ..... F41B 5/12 124/25
5,605,140 A 2/1997 Griffin
5,611,322 A 3/1997 Matsuzaki et al.
5,711,285 A 1/1998 Stewart et al.
5,778,868 A 7/1998 Shepherd
5,797,385 A 8/1998 Thai
5,996,564 A 12/1999 Kotowski
6,076,513 A * 6/2000 Doherty ..... F41B 11/642 124/66
6,224,457 B1 5/2001 Wu
6,500,042 B1 12/2002 LaPointe
6,523,535 B2 * 2/2003 Rehkemper ..... F41B 4/00 124/78
6,598,329 B1 7/2003 Alexander
6,733,356 B2 5/2004 Lee
6,868,845 B1 * 3/2005 Moore ..... F41B 5/126 124/25
7,096,618 B2 8/2006 McGarry
7,287,526 B1 10/2007 Bligh et al.
7,360,331 B2 4/2008 McGarry
7,418,797 B1 9/2008 Crose
7,437,847 B1 10/2008 Mabry
7,458,371 B2 * 12/2008 Ong ..... F41B 11/54 124/59
7,481,209 B1 1/2009 Bligh et al.
7,537,001 B2 * 5/2009 Ma ..... F41B 11/73 124/69
7,552,557 B1 6/2009 Mabry
7,640,922 B2 * 1/2010 Siebelink ..... F41B 3/005 124/17
7,673,624 B2 3/2010 Rosella, Jr.
7,686,003 B2 3/2010 Witzigreuter
7,753,041 B2 * 7/2010 Ogawa ..... F41B 5/12 124/25
7,938,110 B2 5/2011 Udwin
8,082,909 B2 12/2011 Sopinsky et al.
8,091,539 B2 1/2012 Siebelink
8,146,579 B2 * 4/2012 Jablonski ..... F41B 11/54 124/65
D658,726 S 5/2012 Greiner
8,387,605 B2 * 3/2013 Brown ..... F41B 7/08 124/27
8,402,958 B2 * 3/2013 Victor ..... F41A 9/73 124/45
8,567,378 B2 10/2013 Nugent
8,875,690 B2 * 11/2014 Chor-Ming ..... F41A 9/27 124/45
8,955,503 B2 * 2/2015 Corsiglia ..... F42B 6/00 124/78
9,341,422 B2 * 5/2016 Rodich ..... F41A 9/73
2002/0166551 A1 * 11/2002 Lee ..... F41B 4/00 124/78
2006/0180134 A1 * 8/2006 Illuzzi ..... F41A 9/24 124/74
2006/0242880 A1 11/2006 Griffin
2007/0034197 A1 2/2007 Tschech
2007/0261689 A1 11/2007 Tai et al.
2009/0314272 A1 * 12/2009 Lin ..... F41A 9/74 124/48
2010/0147277 A1 6/2010 Zimmerman et al.
2012/0024278 A1 2/2012 Carlson et al.
2012/0024279 A1 2/2012 Carlson et al.
2012/0037138 A1 * 2/2012 Huebl ..... F41A 9/26 124/56
2012/0125304 A1 5/2012 Brooks et al.
2012/0216786 A1 8/2012 Hadley et al.
2015/0233666 A1 * 8/2015 Rodich ..... F41B 5/126 124/25

OTHER PUBLICATIONS

PCTUS1539191 ISR Transmittal, Written Opinion, Search 1-644 PCT papers mailed Dec. 18, 2015.

* cited by examiner

TOY LAUNCH APPARATUS WITH OPEN TOP DART DRUM

PRIORITY CROSS-REFERENCE TO RELATED APPLICATION

This application claims priority pursuant to 35 U.S.C. 119(e) from U.S. Provisional Patent Application No. 62/022,077, filed on Jul. 8, 2014, which application is expressly incorporated herein by reference.

FIELD OF THE INVENTION

The present invention relates generally to a toy dart magazine used in a toy launch apparatus, and more particularly, to a toy launch apparatus having a dart magazine with an open top dart drum that is easy to load and launch and to the open top dart drum alone.

BACKGROUND OF THE INVENTION

The discharge of darts made of soft foam or other material from a toy launcher is well known. These typically use compressed air, springs or oppositely disposed spinning wheels. For example, see U.S. Pat. Nos. 7,287,526, 8,402,958 and 8,567,378. Toy crossbows, however, typically launch darts that are made of a hard material or at least have hard plastic back ends. Revolving magazines on the other hand typically have a drum that receive and store darts within cylindrical sleeves formed in the drum.

Prior patents and devices fail to disclose or illustrate the use of an open top drum allowing the darts to be exposed when the drum is mounted to a toy launch device.

SUMMARY OF THE INVENTION

In accordance with the present invention, an advantageous method and several apparatus embodiments are provided in the form of toy launch apparatus having an open top dart drum. The drum is especially suited for soft foam darts that are launched by the use of a toy crossbow, but is also suitable for launching darts of any suitable material using oppositely disposed rotating wheels or a spring arrangement. By having an open top drum, a user is able to easily determine the quantity of darts stored in the drum and thereby alert the user when there is a need to reload. The open top drum also has the advantage of easy reloading by simply sliding a dart over a post or spike adjacent each chamber or pressing a dart between protrusions. There is no need to remove the drum from the launch apparatus for loading of darts and there is no need to swing the drum away from the launch apparatus as is done with some six shooters. The open top drum is lighter in weight and uses less material and thus may be cheaper to make, and yet, the open top drum is still strongly constructed. The drum and the combination of a drum mounted to a launcher are robust, compact, simply constructed, easy to use and inexpensive, and yet they still have great play value.

Briefly summarized, the invention relates to dart magazines for toy dart launch apparatus including a generally cylindrical drum having an open, uncovered circumferential surface when mounted to the toy dart launch apparatus, the cylindrical drum having a longitudinal axis, a wall formed at a first end of the drum, the wall extending perpendicular to the longitudinal axis of the drum, a second end of the drum spaced away from the first end, a plurality of spaced apart recesses in the circumferential surface of the drum, each recess extending parallel to the longitudinal axis of the drum between the first end wall and the second end and structured to receive and store a dart prior to launch, the dart having a cylindrical body, wherein each recess of the plurality of recesses is structured to leave a portion of the body of a received dart uncovered when the drum is mounted to the toy dart launch apparatus, and a plurality of protrusions mounted to the drum, each protrusion extending parallel to the longitudinal axis of the drum, wherein each protrusion is located and structured to restrain the dart received by the recess. The invention also includes the toy dart launch apparatus with the drum described above.

The invention also relates to a method for assembling the toy dart launch apparatus including the steps of forming a housing, mounting an energy generating mechanism to the housing for engaging and causing the toy dart to discharge, mounting a trigger to the housing, connecting the trigger to the energy generating mechanism for activating the energy generating mechanism, forming a generally cylindrical drum, the cylindrical drum having a longitudinal axis, a plurality of spaced apart recesses in the circumferential surface, each recess extending parallel to the longitudinal axis and structured to receive and store a dart prior to launch, and a plurality of protrusions, each protrusion extending parallel to the longitudinal axis, wherein each protrusion is located and structured to restrain the dart received by the recess, and mounting the drum to the housing wherein the circumferential surface of the drum is uncovered and each recess of the plurality of recesses is structured to leave a portion of the dart uncovered.

BRIEF DESCRIPTION OF THE DRAWINGS

For the purpose of facilitating an understanding of the invention, the accompanying drawings and detailed description illustrate preferred embodiments thereof, from which the invention, its structures, its constructions and operations, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the inventions. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
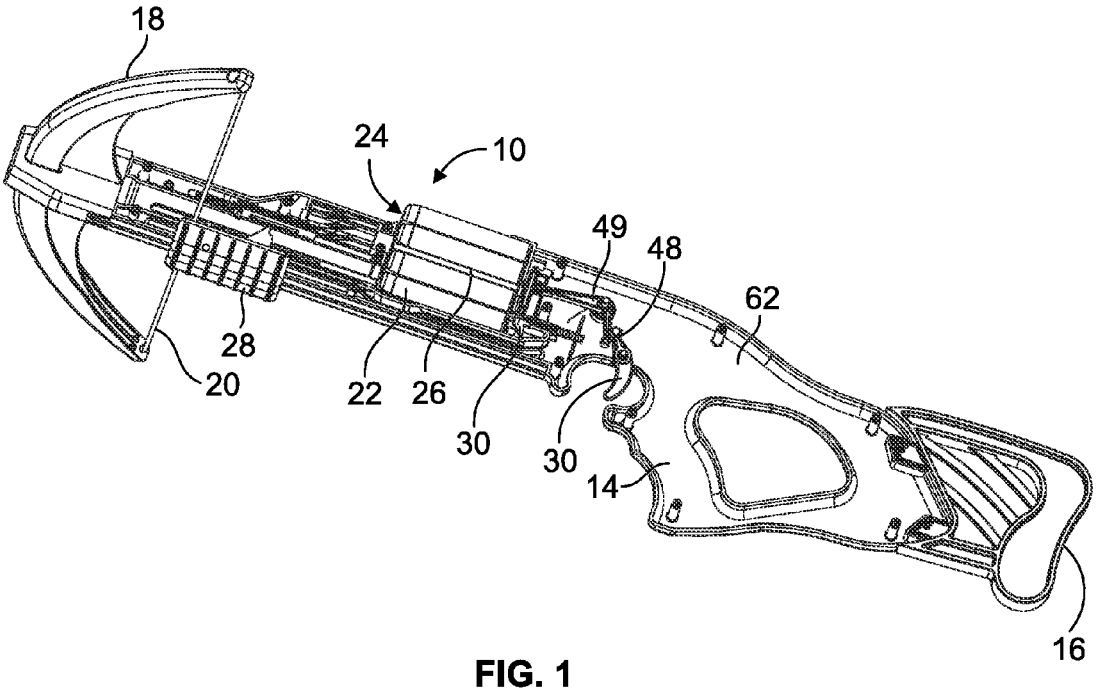
FIG. 1 is an upward looking isometric view of an embodiment of a toy dart launch apparatus in the form of a bottom cocking toy crossbow with an open top dart drum, the crossbow being in a relaxed configuration and with half of a housing removed.
Figure 2:
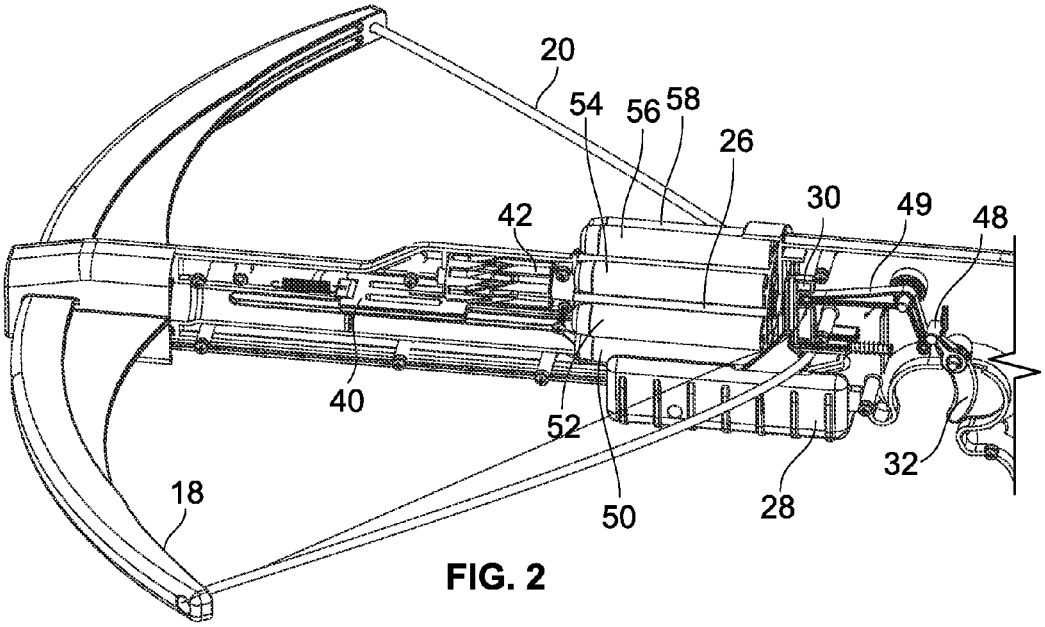
FIG. 2 is an enlarged downward looking isometric view of a portion of the toy crossbow shown in FIG. 1, but in a cocked configuration.
Figure 3:
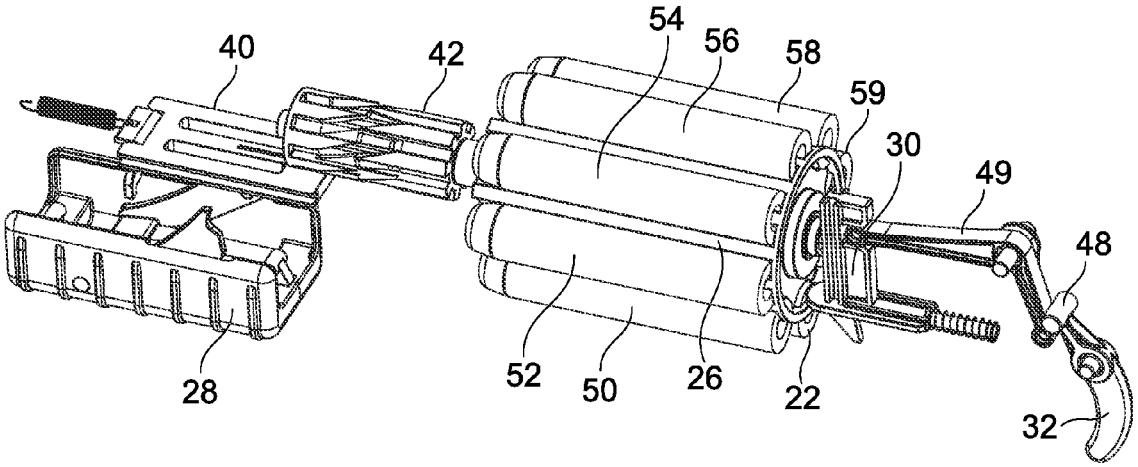
FIG. 3 is a downward looking enlarged isometric view of a portion of the toy crossbow shown in FIGS. 1 and 2 with the housing removed.

Referring to FIGS. 1-3, there is illustrated a toy launch apparatus in the form of a toy crossbow 10 having a housing 12, the housing including a grip portion 14 toward the rear of the housing, a shoulder stock 16 at the rear of the housing and a bow portion 18 at the front of the housing. A stretchable string or cord 20 is mounted to the bow portion 18. The stretchable cord 20 is part of an energy generating mechanism that is used to transfer energy to a dart, such as the dart 22, located at the bottom of a magazine 24. The magazine, including an open top dart drum 26, is mounted to the housing 12 as shown. The stretchable cord 20 functions by having a user of the crossbow move the cord from a relaxed position shown in FIG. 1, to a stretched or cocked position shown in FIG. 2. When the stretched cord 20 is released from the stretched position, the stored energy in the cord is transferred to the dart 22 as the cord impacts the dart when it snaps back to the relaxed position. A cocking slide 28 mounted along the bottom of the housing 12 is used to stretch the cord to the cocked position. The slide 28 is also part of the energy generating mechanism as is a latch or lock element 30 used to maintain the cord in the cocked position. Also, mounted to the housing 12 is a trigger 32 that is operatively connected to the lock element 30 and is used to release the cord. The lock element is part of a safety feature for the toy apparatus as detailed fully in co-pending application entitled TOY PROJECTILE LAUNCHERS WITH TWO TRIGGER SAFETY LOCKS filed on even date Ser. No. 14/791,294 and expressly incorporated herein by reference.

The toy cross bow 10 is cocked when a user moves the slide 28 from a forward relaxed position shown in FIG. 1, to the rearward cocked position shown in FIG. 2, and back to the forward position. In addition to mounting the magazine 24 to the housing 12, a cam mechanism that includes a cam slide 40 and a cam follower 42 is also mounted to the housing. The cam follower 42 is connected to the open top dart drum 26 so as to rotate the dart drum each time the slide 28 is moved from the forward position to the rearward position and back to the forward position. The trigger 32 is pivotally mounted to the housing and is integral with a forward extending link 48, which is connected to a second link 49. The second link 49 is configured to move the latch 30 when the trigger 32 is pulled. When the trigger 32 is pulled rearward the latch is moved upward and the stretched cord 20 is released. The freed cord impacts the dart 22 to cause the dart to be discharged from the toy crossbow 10.

Figure 4:
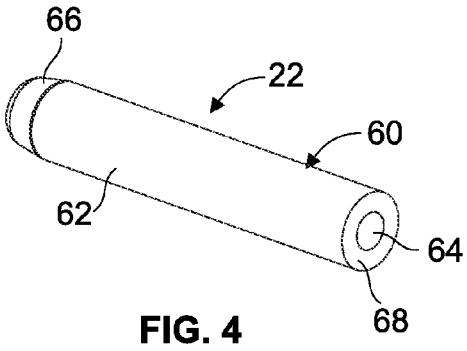
FIG. 4 is an enlarged rear isometric view of a soft foam dart of the kind that may be mounted and stored in the open top dart drum.
Figure 5:
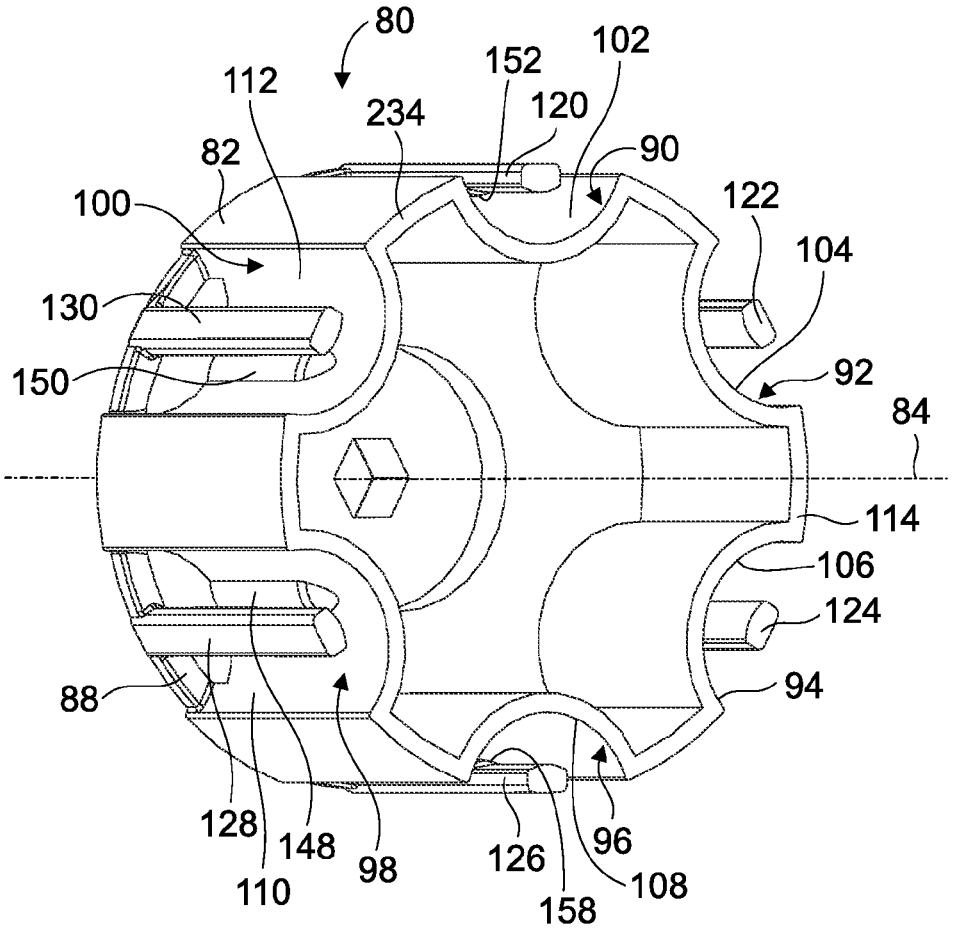
FIG. 5 is a partial enlarged front isometric view of the open top dart drum.
Figure 6:
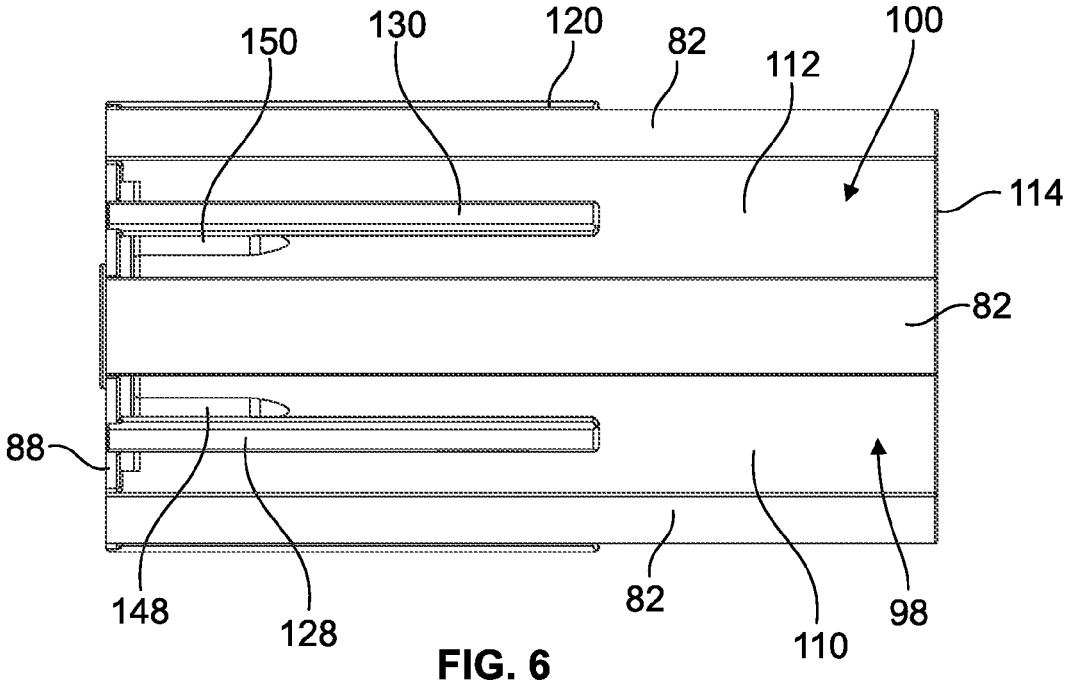
FIG. 6 is a side elevation view of the open top dart drum shown in FIG. 5.
Figure 21:
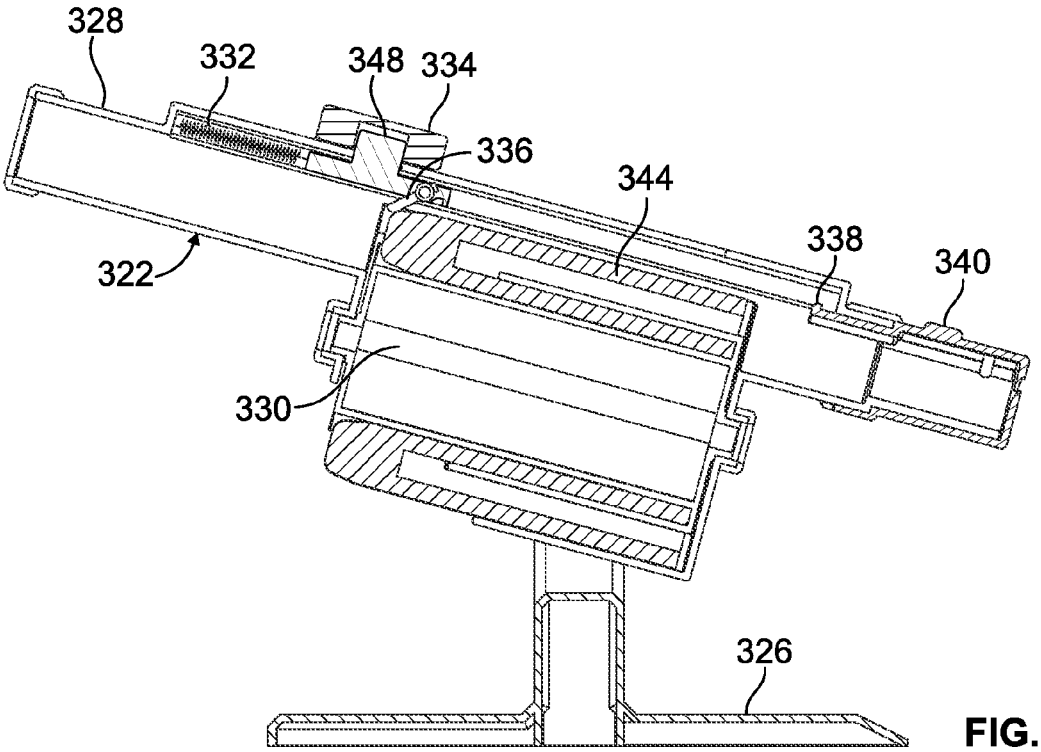
FIG. 21 is a longitudinal section view of the toy cannon shown in FIG. 20, the toy cannon having a drive spring shown in a relaxed configuration.

Stored in the open top dart drum 26, in addition to the bottom-most dart 22, may be seven more darts of which six darts 50, 52, 54, 56, 58, 59 are visible. The darts supported by the open top dart drum are preferably formed of soft foam such as those marketed under the brand NERF®. Each dart identified above, such as the dart 22, FIG. 4, is configured with a cylindrical main tube or body 60 with an outer surface 62, a central opening 64, a nose 66, and a rear ring-shaped wall 68. The nose 66 is formed of a Kraton™ polymer elastomer thermoplastic rubber or the like. In the alternative, the body may have a generally square cross section or other suitable shape and may be made of other suitable material. In operation, the rear wall 68 is impacted by the energy generating mechanism, such as the cord 20, FIG. 1, the cord 228, FIG. 16, or a tab 336, FIG. 21; or, wheels 310, 312, FIG. 19, of the toy rifle 280 may engage the outer surface 62 of the dart to transfer energy for discharge. The NERF brand foam dart described above is well known and is used with a number of different toy launchers marketed by Hasbro, Inc., of Rhode Island.

Figure 7:
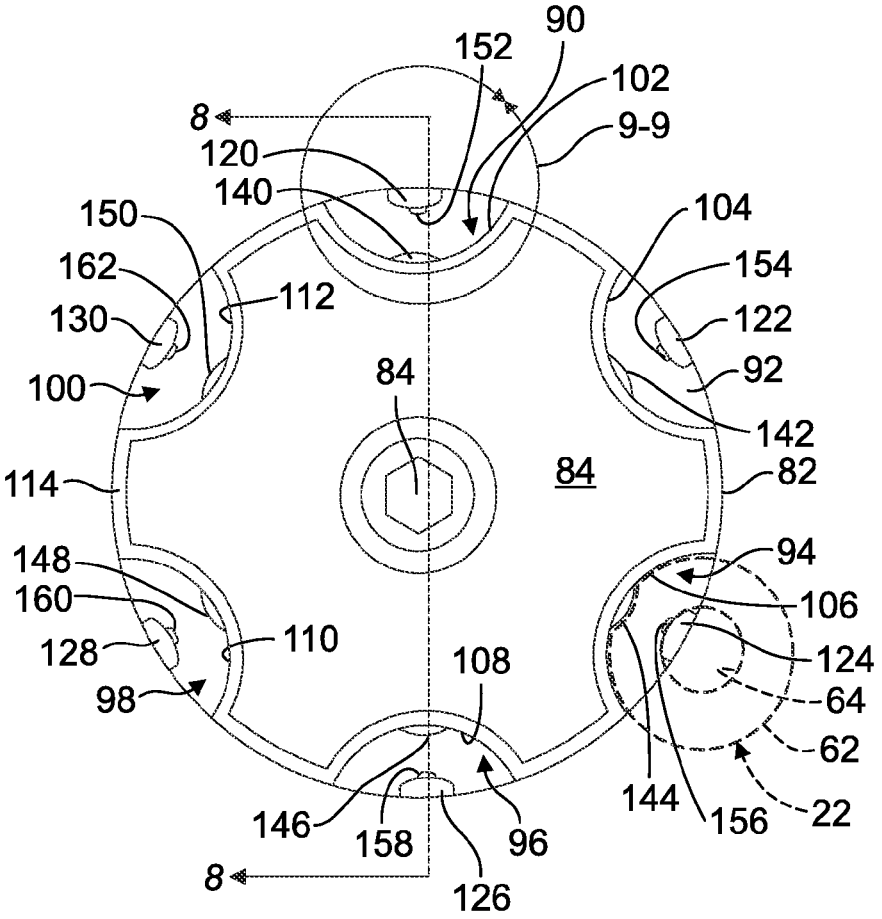
FIG. 7 is a front elevation view of the open top dart drum shown in FIGS. 5 and 6 with a mounted dart in phantom line.
Figure 8:
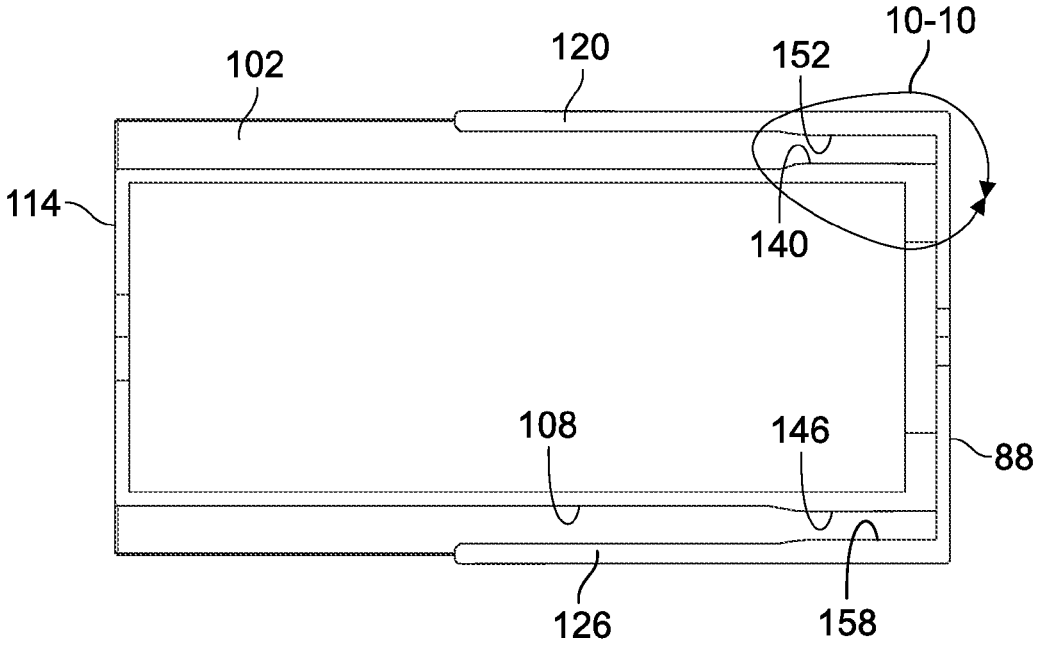
FIG. 8 is a partial side sectional view taken along line 8-8 of FIG. 7.
Figure 9:
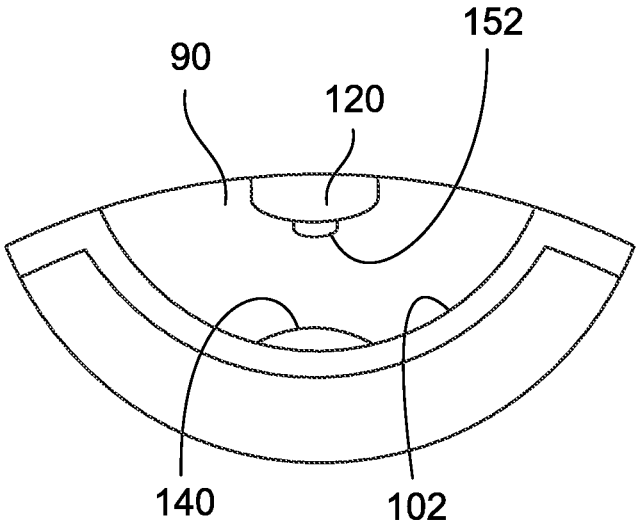
FIG. 9 is an enlarged view taken within circle 9-9 of FIG. 7.
Figure 10:
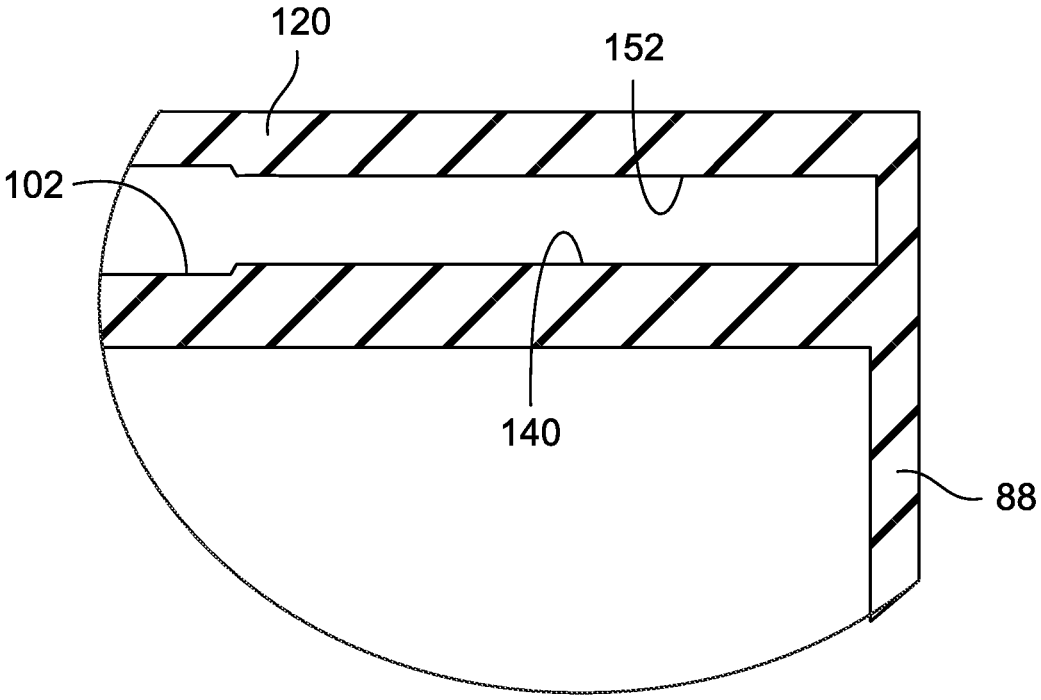
FIG. 10 is an enlarged view taken within enclosure 10-10 of FIG. 8.
Figure 11:
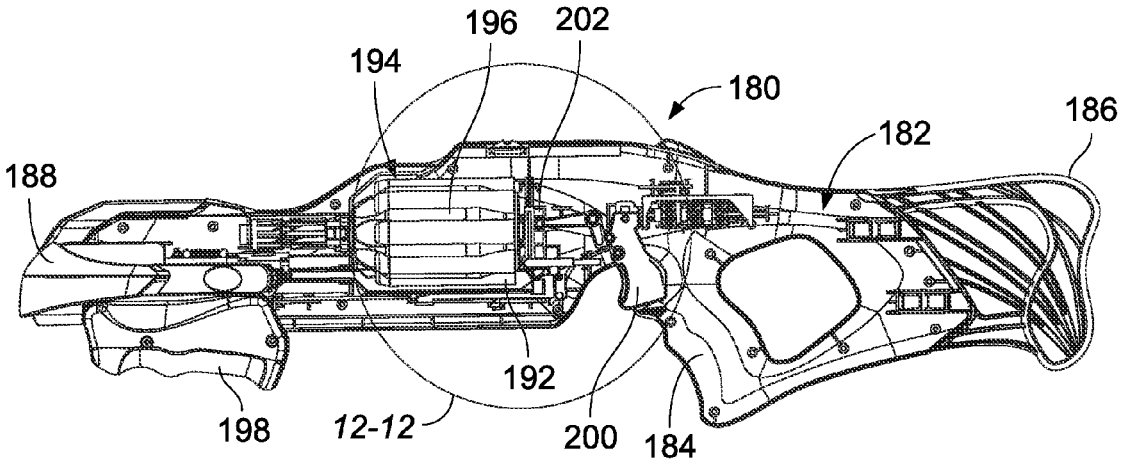
FIG. 11 is a side elevation view of a toy crossbow embodiment similar to that shown in FIG. 1, illustrating a dart-supporting platform in a lowered position.
Figure 12:
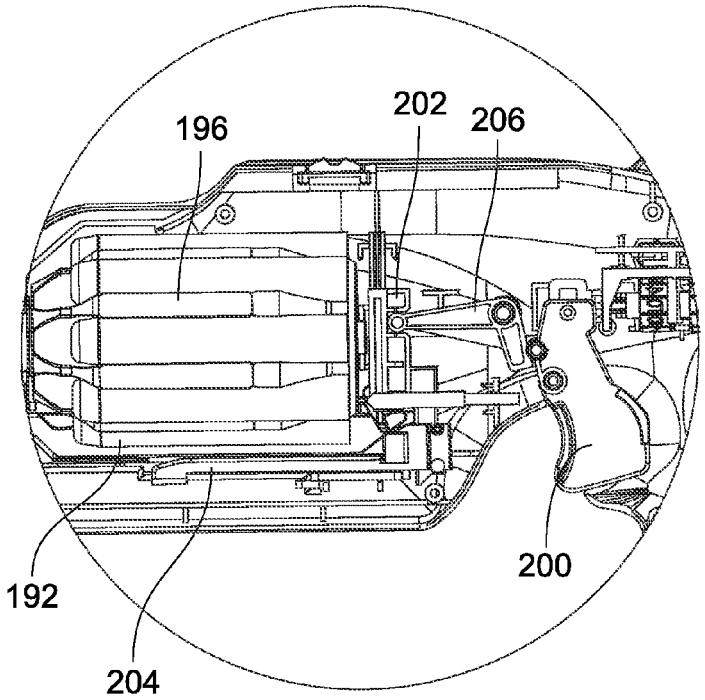
FIG. 12 is an enlarged view taken within circle 12-12 of FIG. 21.
Figure 13:
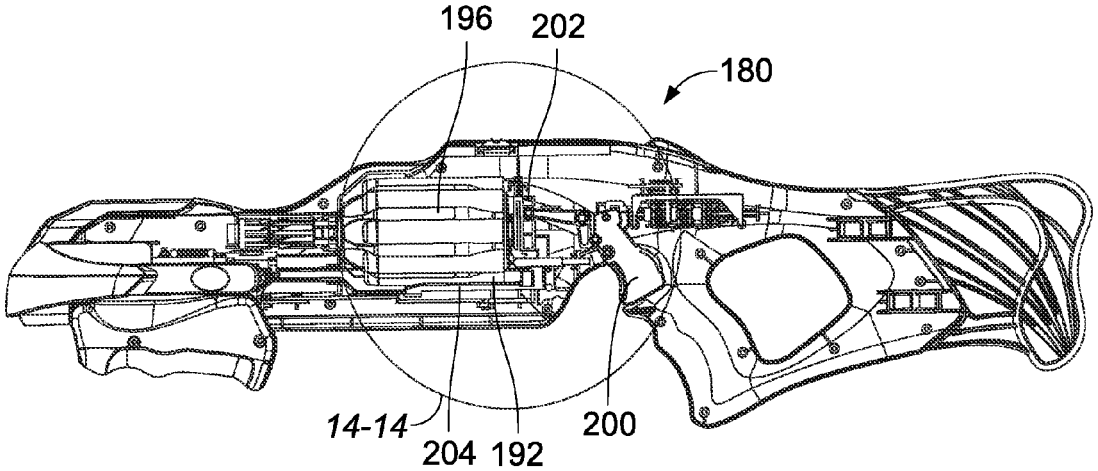
FIG. 13 is a side elevation view of the toy crossbow embodiment shown in FIG. 11, illustrating the dart-supporting platform in a raised position.
Figure 14:
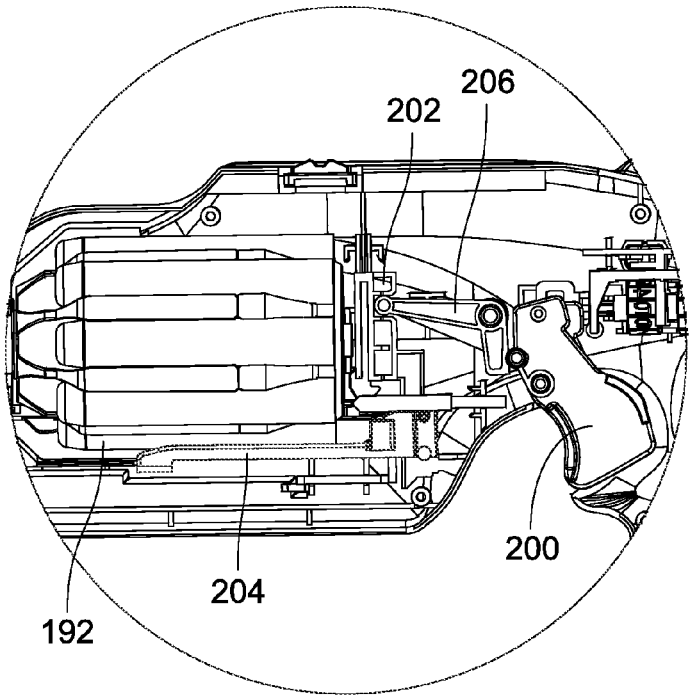
FIG. 14 is an enlarged view taken within circle 14-14 of FIG. 13.
Figure 15:
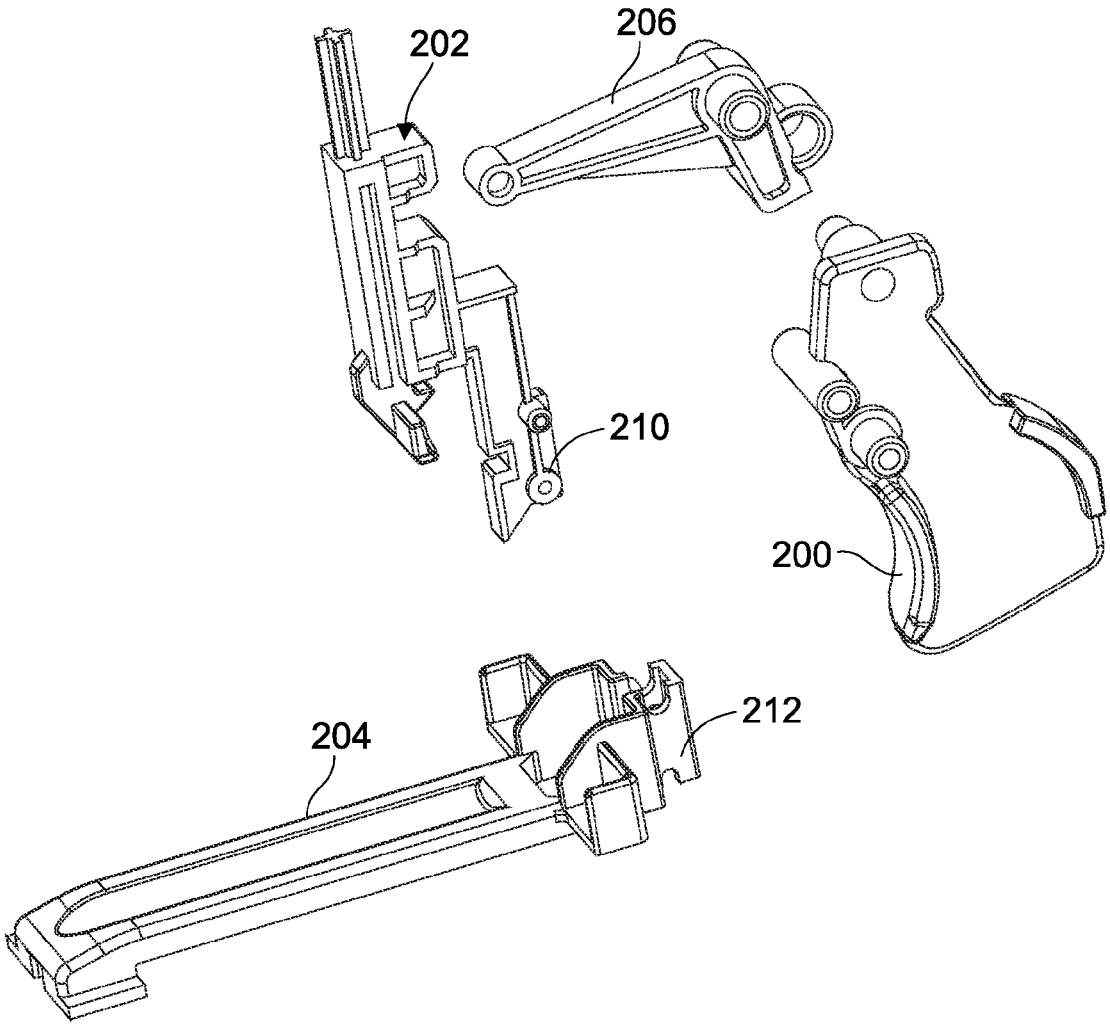
FIG. 15 is an enlarged exploded isometric view of selected structure of the toy crossbow shown in FIGS. 11-14.

Each magazine described herein, except where noted, includes a generally cylindrical drum 80, FIGS. 5-10, having an uncovered curved outer or circumferential surface 82 and a longitudinal axis 84. At a first end of the drum is a rear wall 88 disposed perpendicular to the longitudinal axis 84 of the drum. Around the outer surface of the drum is a plurality of recesses, such as the six evenly spaced apart recesses 90, 92, 94, 96, 98, 100. A corresponding curved wall 102, 104, 106, 108, 110, 112, borders each recess. More or less recesses may be designed into a drum. For example, the drum 26, FIGS. 1-3, has eight recesses. The recesses function as open chambers for darts loaded on the drum. Each recess extends forward from the rear wall 88 of the drum to a second or front end 114 of the drum. Each curved wall of the recesses forms an approximate half of a cylinder (or less than one-half of a circle when viewed in cross section as shown in FIGS. 7 and 9), and function to receive and store the previously described darts or other suitable projectile.

Mounted to and extending forward from the rear wall 88 and operatively aligned with or spaced from the corresponding recess wall 102, 104, 106, 108, 110, 112 may be six spikes or posts 120, 122, 124, 126, 128, 130, respectively. Each dart received by the drum is mounted to a corresponding spike by slipping the dart's central opening 64, FIG. 4, over a spike, such as the spike 124, like a sleeve over an arm, as shown with the dart 22 drawn in phantom line in FIG. 7, where a portion of the outer surface 62 of the dart is adjacent the curved wall of the recess, like the wall 106 of the recess 94. Each of the spikes 120, 122, 124, 126, 128, 130 extend toward the front end 114 and is shaped with a somewhat flattened configuration so that a supported dart may be easily mounted and removed from the spike, and the dart may be discharged without a noticeable loss of discharge energy resulting from friction. Also extending forward from the rear wall 88 are adjoining protrusions 140, 142, 144, 146, 148, 150 mounted to the recess walls. Opposite each wall protrusion 140, 142, 144, 146, 148, 150 is a second short protrusions 152, 154, 156, 158, 160, 162 mounted to the spikes 120, 122, 124, 126, 128, 130. Together each pair of oppositely disposed protrusions function to slightly squeeze the body 60 of a mounted soft foam dart (again as shown in phantom line in FIG. 7) so that a stored dart will not slip out of the drum should the launcher be pointed downward, but nevertheless, the protrusions do not inhibit the discharge of the dart. If the spike is not used or needed, a protrusion or two (or more) may be formed integral with the drum and used to capture a dart until discharge, with each curved wall of the recesses extending slightly more than 180 degrees to restrain and hold the dart.

A drum is mounted to each housing of the dart launcher embodiments disclosed in detail here and remains uncovered when mounted. The result is that darts stored on the drum are accessible as are empty recesses. The drum structure shown here is contrasted with the usual gun magazine in which a drum includes a plurality of cylindrical openings beneath or covered by the outer or circumferential surface. The openings are used to store bullets, cartridges or darts. Here, each drum is mounted to a toy launch apparatus housing, such that a portion of the body 60 of the dart is uncovered and is accessible to a user for visual inspection to show the number of darts loaded in the magazine as well as for facilitating loading of additional darts in empty recesses or chambers without having to either remove the drum from the housing or relocate the drum relative to the housing. Removing or relocating the drum is the usual practice with traditional guns and launchers, although in the alternative, empty or near empty drums may be replaced with fully loaded drums. In addition, the open and uncovered drum provides room for a cord or a tab when they are employed to engage a dart mounted in a recess and cause discharge.

Referring now to FIGS. 11-15, there is illustrated a modified embodiment of a toy launch apparatus in the form of a bottom cocking toy crossbow 180 that is very similar to the toy crossbow 10, FIG. 1. The toy crossbow 180 includes a housing 182, and the housing including a grip portion 184, a shoulder stock 186, and a bow portion 188. A stretchable string or cord (not shown) is mounted to the bow portion 188. The stretchable cord is part of an energy generating mechanism that is used to transfer energy to a dart, such as the dart 192, located at the bottom of a magazine 194. The magazine, including an open top dart drum 196, is mounted to the housing 182. A cocking slide 198 mounted along the bottom of the housing 182 is used to stretch the cord to the cocked position as was done with the crossbow 10. Also mounted to the housing 182 is a trigger 200 that is operatively connected to a lock element or latch 202 and is used to release the cord.

An additional structure for strengthening a dart at launch so as to increase the dart's life span is included in the form of a platform 204. The platform 204 is connected to the trigger 200 by a link 206, FIG. 15, that operates the lock element 202. The lock element 202 includes a tab 210 to engage a flange 212 on the platform 204 to raise the platform at the same time that the lock element is raised. When the trigger 200 is pulled to discharge a dart, the platform 204 is raised to gently press against the dart to be impacted by the cord. Raising the platform 204 gives added support to the impacted dart to prevent distortion and shredding of the dart. Hence, the added support of the platform for the dart at the time of impact extends the useful life of the soft foam dart.

Figure 16:
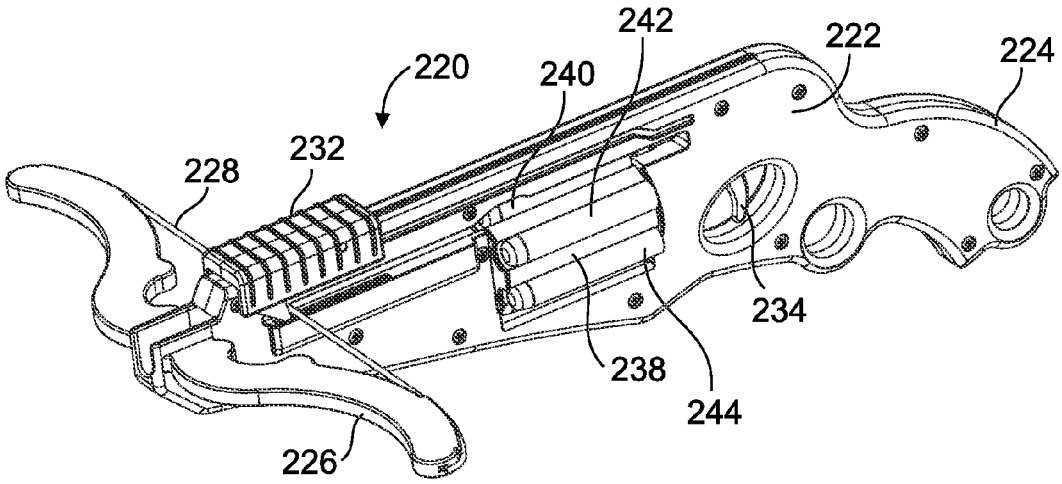
FIG. 16 is an downward looking isometric view of another embodiment of a toy launch apparatus in the form of a top cocking toy crossbow with an open top dart drum, the crossbow being shown in a relaxed configuration.
Figure 17:
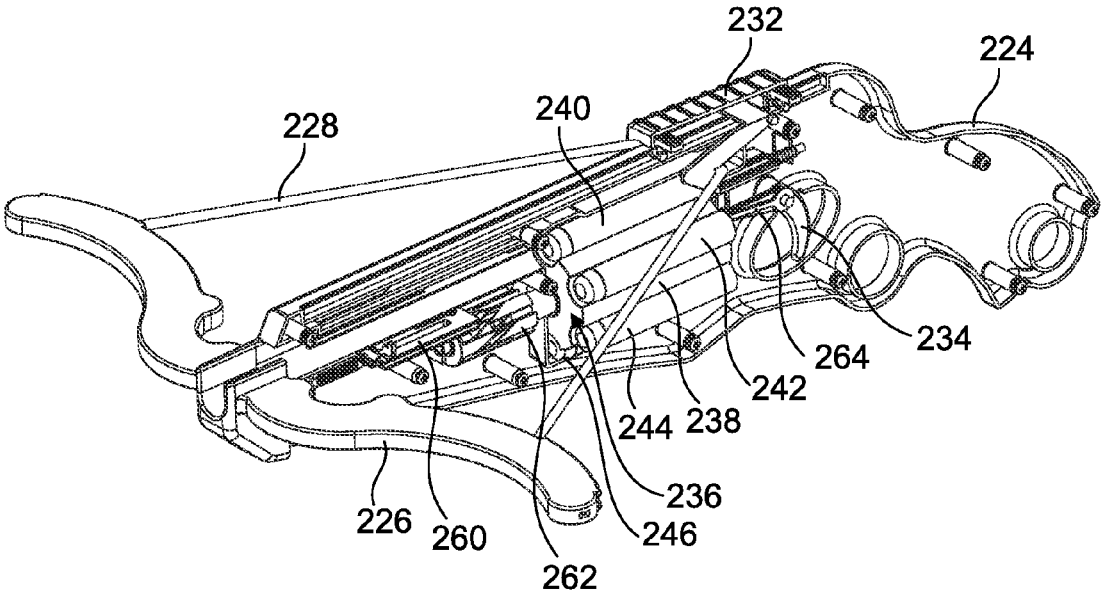
FIG. 17 is an isometric view of a portion of the toy crossbow shown in FIG. 16, but in a cocked configuration.
Figure 18:
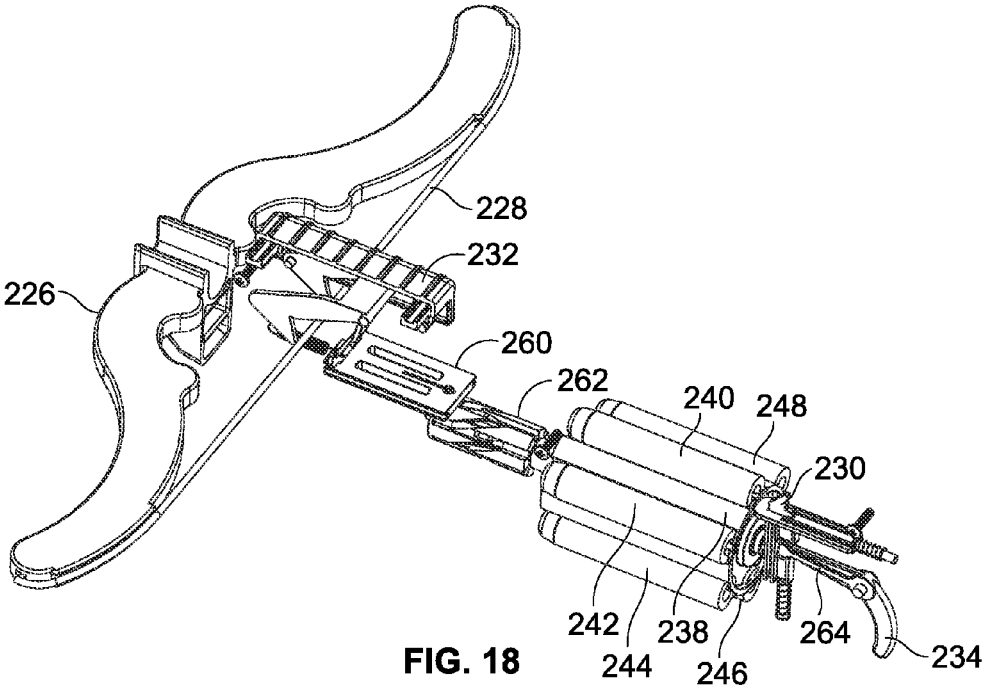
FIG. 18 is an isometric view of a portion of the toy crossbow shown in FIGS. 16 and 17, with the housing removed.

Illustrated in FIGS. 16-18, is another embodiment of a toy dart launch apparatus in the form of a toy crossbow 220 having a housing 222, the housing including a grip portion 224 at the rear and a bow portion 226 at the front. A stretchable cord 228 is mounted to the bow portion 226. The energy generating mechanism includes the stretchable cord 228, shown in a relaxed position in FIG. 16, and in a stretched position in FIG. 17. The energy generating mechanism also includes a latch or lock element 230 and a slide 232 for cocking the crossbow 220. In the embodiment illustrated in FIGS. 16-18, the cocking slide 232 is mounted to move along the top of the housing 222. A trigger 234 is mounted to the housing 222 and operates the latch 230 to release the stretched cord 228. Also mounted to the housing 222 is a magazine 236 having an open top dart drum 238. Mounted to the dart drum 238 are six darts like that described for the drum 80, FIG. 5, of which five darts 240, 242, 244, 246, 248 are shown.

The toy crossbow 220 is cocked when a user moves the cocking slide 232 from a forward position to the rearward position and back. Mounted within the housing 222 is a cam mechanism including a cam slide 260 and a cam follower 262. The cam follower 262 is operatively connected to the open top dart drum 238 for rotating the dart drum each time the cocking slide 232 is moved from its forward position to its rearward position and back. The trigger 234 is pivotally mounted to the housing 222 and is integral with a forward extending link 264. The extending link 264 is operationally connected to the latch 230. When the trigger 234 is pulled rearward, the latch 230 moves downward to release the stretched cord 228. The energy stored in the stretched cord is transferred to a top-most dart, such as the dart 240, mounted to and stored on the open top dart drum 238.

It is noted that the open top drum 238, FIG. 16, allows the cord 228 to engage the upper outboard half of the dart 240 to cause discharge. With the open top drum 26, FIGS. 1-3, in the earlier described embodiment, the cord 20 is able to engage the lower outboard half of the dart 22 to cause discharge. As discussed in detail above, additional structure may be used to strengthen the cord-engaged dart at the time of impact by the cord on the dart. The structure may be a platform (not shown) that lowers onto the dart when the trigger is pulled in an upside down version of the platform 204 shown and describe in detail in relation to FIGS. 11-15. The toy crossbow 220 may also have the safety features described in the co-pending application entitled TOY PRO- JECTILE LAUNCHERS WITH TWO TRIGGER SAFETY LOCKS already incorporated herein by reference.

Figure 19:
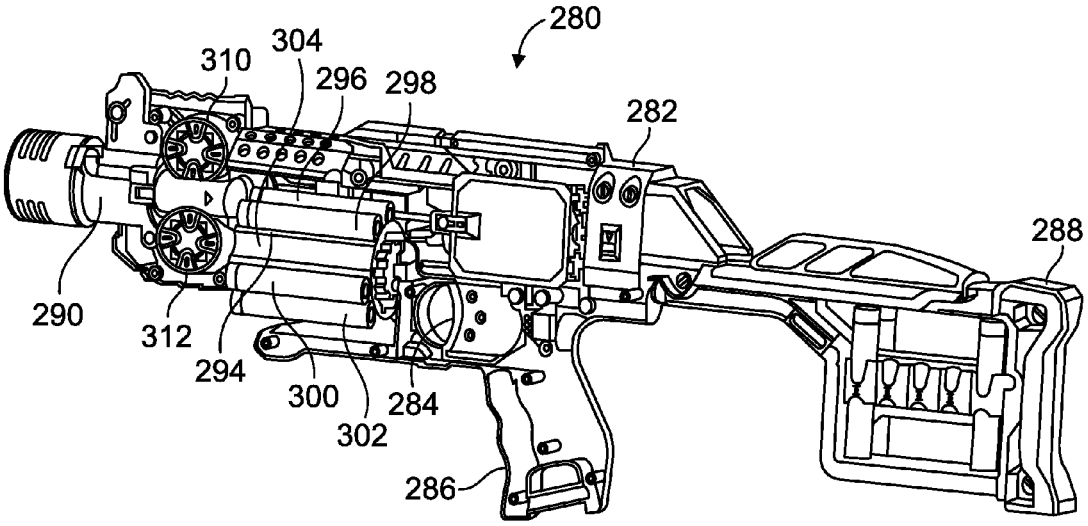
FIG. 19 is an isometric view of still another embodiment of a toy launch apparatus in the form of a motorized toy rifle with rotatable wheels and an open top dart drum where a portion of a housing has been removed.

Still another embodiment of a toy foam dart launch apparatus is illustrated in FIG. 19, where the toy launch apparatus appears as a stylized automatic toy rifle 280. The toy rifle 280 includes a housing 282 having a grip portion 286, a shoulder stock 288 and a barrel portion 290. A trigger 284 is mounted to the housing. The shoulder stock may be used to store additional darts. The toy rifle 280 also includes a magazine with an open top drum 294. Eight darts may be mounted on the drum 294, of which only four darts 296, 298, 300, 302 are illustrated here without spikes on drum 294. An empty dart chamber 304 in the open top drum 294 is also illustrated. An energy generating mechanism is mounted in the housing 282 in the form of two battery-operated rotating wheels 310, 312. The barrel portion 290, the grip portion 286 and the shoulder stock 288 may be molded of a suitable plastic integral with the housing 282. The trigger 284 is connected to the batteries (not shown) for energizing the wheels 310, 312. The trigger 284 is used additionally to advance or push the darts from the drum 294 into the wheels 310, 312. It is noted that where rotating wheels are the energy source to cause discharge, spikes on the drum may not be needed and protrusions or the curved walls of the recesses may be used to restrain and hold the darts. The protrusion or protrusions for each dart may be placed in any convenient location on the drum so as to bear against the dart. In the situation where a cord is not going to impact a dart, a platform may not be needed as is the case with the toy rifle 280.

Figure 22:
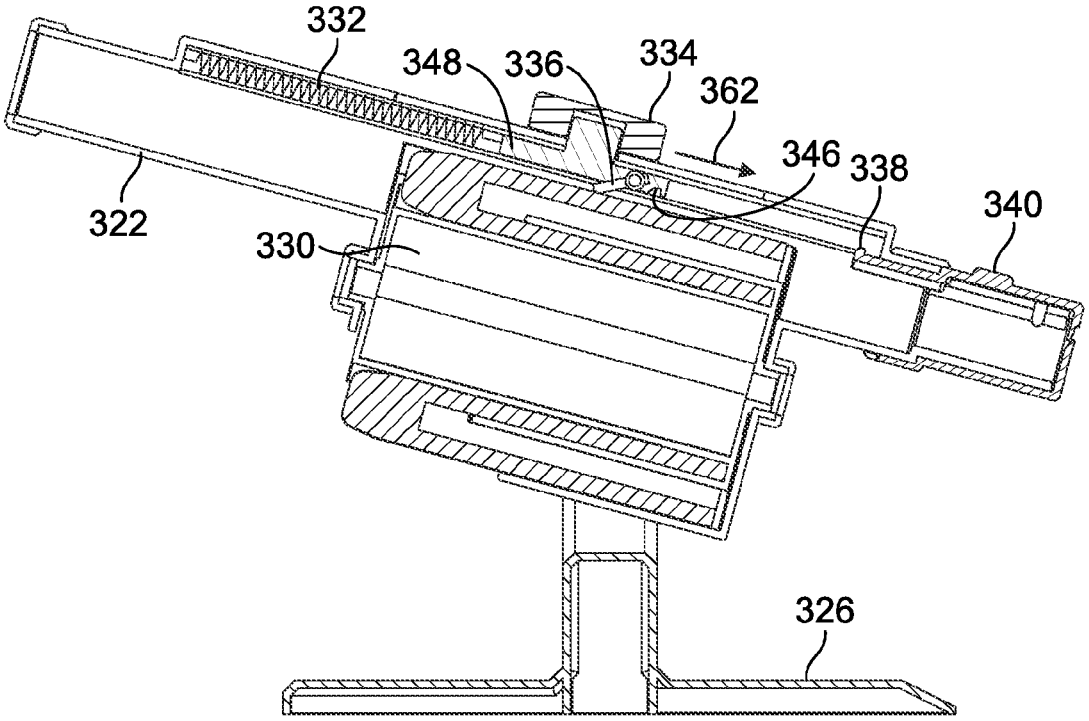
FIG. 22 is a longitudinal section view of the toy cannon shown in FIGS. 20 and 21, where the drive spring is shown in a partially cocked configuration.
Figure 23:
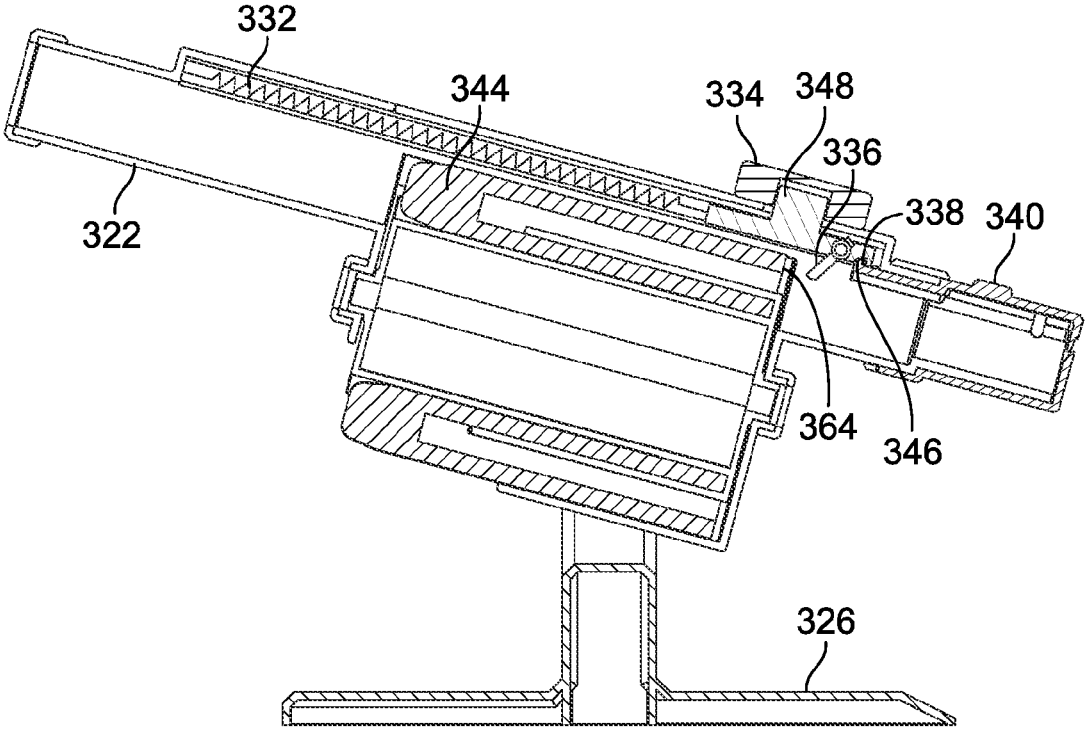
FIG. 23 is a longitudinal section view of the toy cannon shown in FIGS. 20-22, where the drive spring is fully extended.
Figure 24:
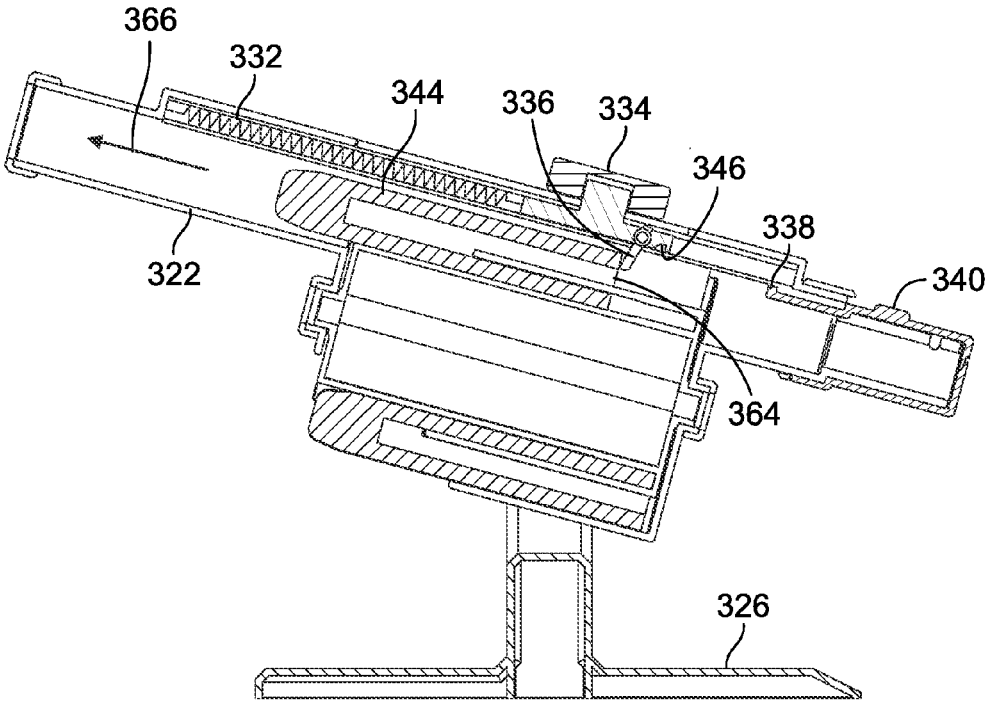
FIG. 24 is a longitudinal section view of the toy cannon shown in FIGS. 20-23, after a trigger has been activated.
Figure 25:
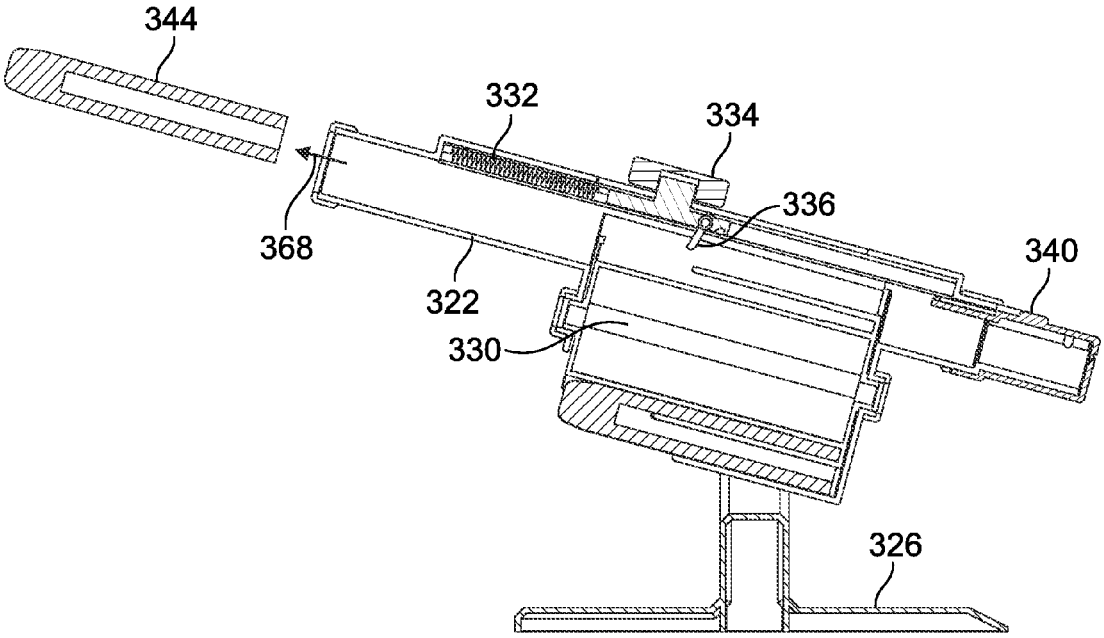
FIG. 25 is a longitudinal section view of the toy cannon shown in FIGS. 20-24, illustrating a dart leaving the cannon and the drive spring returning to a relaxed configuration.

Referring now to FIGS. 20-25, there is illustrated yet another embodiment of a toy dart launcher, which takes the form of a toy cannon 320. The toy cannon 320 includes a tubular housing 322, a rotatable support ring 324, a stand 326, a barrel 328 and a dart magazine having an open top drum 330. Mounted to the cannon 320 is an energy generating mechanism that includes a drive spring 332 mounted above the barrel 328, a cocking slide 334 mounted to the tubular housing 322 and connected to the drive spring 332 and a rotatable tab 336. A latch 338 is connected to a trigger 340 mounted to the tubular housing 322. The slide 334 stretches the drive spring 332 by being moved rearward from a relaxed forward position shown in FIG. 21, to a rearward stretched position shown in FIG. 23. Connected to the slide 334 is the rotatable tab 336 for engaging a top-most dart, such as the dart 344, in the open top drum 330 after the drive spring 332 is fully extended. In the cocked position the slide 334 and the drive spring 332 are restrained because the latch 338 engages in a notch 346 in a base 348 connected to the slide 334 as shown in FIG. 23.

Figure 20:
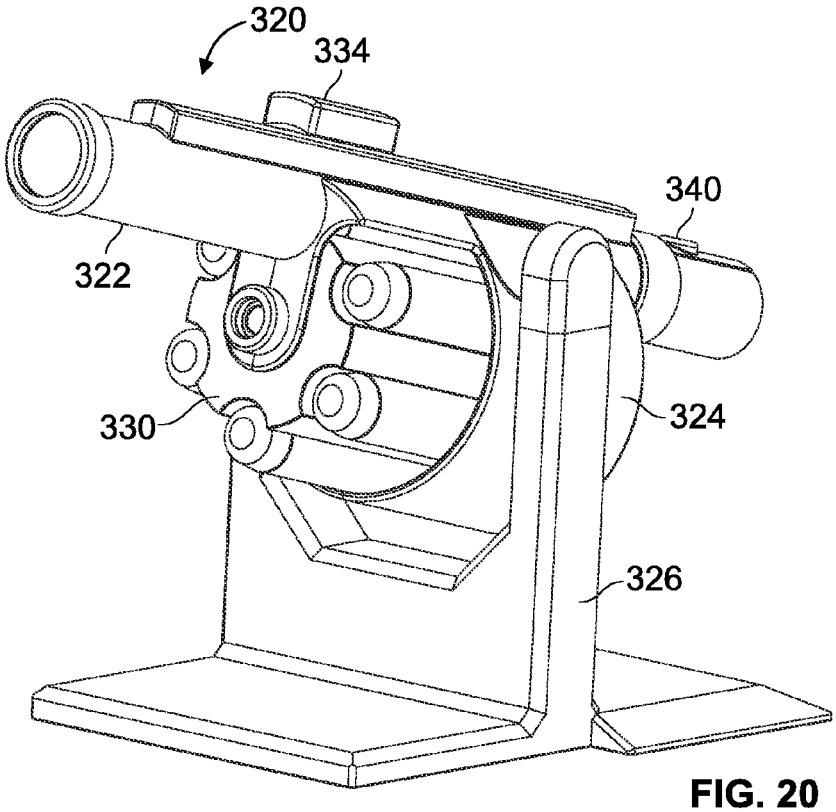
FIG. 20 is an isometric view of yet another embodiment of a toy dart launch apparatus in the form of a toy cannon with an open top dart drum.

In operation of the toy cannon 320, FIG. 20, the open top drum 330 receives and stores several darts (where one of the darts is in the upper-most position, such as the dart 344), the slide 334 is moved rearward by a user as indicated by an arrow 362, FIG. 22, and the drive spring 332 is partially extended as shown in FIG. 22. When the slide 334 is moved to a sufficiently rearward position shown in FIG. 23, the drive spring 332 becomes fully extended and acts like the earlier described cords in that the extended spring has stored energy. At the same time, the latch 338 engages in the notch 346 in the base 348 supporting the tab 336 and the slide 334. The tab 336 is rotated from a raised position shown in FIG. 22 to a lowered position shown in FIG. 23. When the user depresses the trigger 340 the notch 346 is disengaged from the latch 338, the drive spring 332 is released and the drive spring snaps forward causing the tab 336 to engage a portion of a back wall 364, FIGS. 23 and 24 of the dart 344. Under the influence of the rapidly contracting drive spring 332, the tab 346 pushes the dart rapidly toward discharge as indicated by an arrow 366, FIG. 24. Illustrated in FIG. 25, the dart 344 is shown exiting the cannon, as indicated by the arrow 368, the drive spring 332 is almost back to its relaxed position, and the slide 334 has almost returned to its forward position. A platform or other structure may be added to support the discharging dart if desired.

In operation of the toy crossbow 10 shown in FIGS. 1-3, the open top drum 26 is loaded with darts, the slide 28 is moved rearward by the user to stretch the cord 20 and store energy for discharge. When in its rearward position, the cord 20 is restrained by the latch 30. The bottom-most dart 22 is discharged when the trigger 32 is pulled and the stretched cord is released. The toy crossbow embodiment shown in FIGS. 11-14 and 16-18, operates in the same manner as the embodiment shown in FIGS. 1-3, except in the embodiment shown in FIGS. 16-18, the cord discharges the top-most dart 240. The toy rifle embodiment shown in FIG. 19, operates differently from the crossbows and the cannon because energy is imparted to the dart 296 by battery operated spinning wheels 310, 312 and not from a stretched cord or spring.

The dart carrying open top drum illustrated in the toy launcher embodiments described above may share the same structure, except perhaps for size. In operation of the open top drum, a dart is easily loaded over each spike aligned with and located adjacent a recess wall because the drum is open at the top. There is no need to remove the drum from a dart launch apparatus for loading or to move it at all. The drum's configuration allows more than half of the rear wall of the stored darts to be exposed and engaged by an energy transfer apparatus such as a cord, like the cords 20, 228, FIGS. 1-3 and 16-18, respectively.

The open top dart drum has a number of features. First, the drum is easily molded in one piece and yet has a robust construction. The drum may be easily loaded with darts, as mentioned, because there is no space-restricting closed top surface. The open top dart drum weighs less and uses less material than the traditional and comparably sized closed toy drum. The open top drum feature also makes it easy for a user to determine how many darts remain in the drum and when the number is low or zero, when there is a need to reload.

In the alternative, the dart drum may be made larger or smaller and support more or less than six darts. Or, the drum 26, FIGS. 1-3, may be designed differently to carry eight darts as compared to the six-dart drum 80, FIG. 5. The diameter of the drum may be a function of the size of the darts used such that smaller darts may result in smaller drums and larger darts may result in larger drums, or with the same size darts, a larger drum may support more darts.

It is noted that throughout this description, words such as "forward," "rearward," "front," "rear" and "top-most," as well as similar positional terms, refer to portions or elements of the toy launch apparatus or drums as they are viewed in the drawings relative to other portions, or in relationship to the positions of the apparatus as it will typically be held and moved during play by a user, or to movements of elements based on the configurations illustrated.

Figure 26:
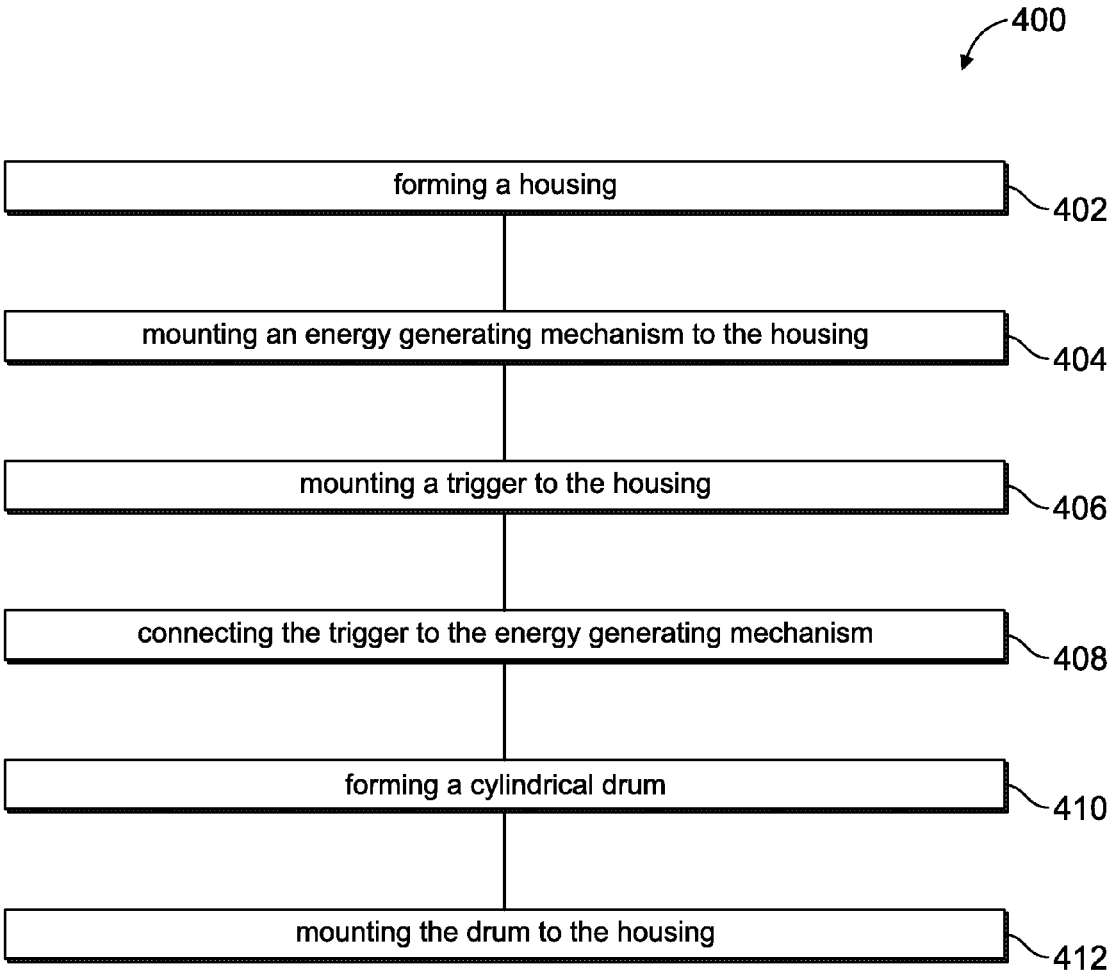
FIG. 26 is a flow diagram of a method for assembling a toy dart launch apparatus.

The present invention also includes a method 400, FIG. 26, for assembling a toy dart launch apparatus including the steps of forming a housing 402, mounting an energy generating mechanism to the housing for engaging and causing the toy dart to discharge 404, mounting a trigger to the housing 406, connecting the trigger to the energy generating mechanism for activating the energy generating mechanism 408, forming a generally cylindrical drum 410, the cylindrical drum having a longitudinal axis, a plurality of spaced apart recesses in the circumferential surface, each recess extending parallel to the longitudinal axis and structured to receive and store a dart prior to launch, and a plurality of protrusions, each protrusion extending parallel to the longitudinal axis, wherein each protrusion is located and structured to restrain the dart received by the recess, and mounting the drum to the housing 412 wherein the circumferential surface of the drum is uncovered and each recess of the plurality of recesses is structured to leave a portion of the dart uncovered. The method may also include the steps of locating a second set of protrusions opposite the first mentioned protrusions, mounting spikes to the drum in alignment with the recesses and mounting a platform to bear against a dart when the dart is engaged with an energy generating mechanism.

The toy launch apparatus and open top drums disclosed in detail above have great play value, are fun to use and easy to operate, and are safe, even for young children, and yet the launch apparatus and drums have robust, but simple structures, that may be produced at reasonable cost.

From the foregoing, it can be seen that there has been provided features for improved toy launch apparatus and a disclosure of a method for assembling the toy launch apparatus, as well as features for an improved dart drum to be used as part of the toy launchers. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy dart launch apparatus comprising:
a housing;
an energy generating mechanism mounted to the housing for discharging a dart having a deformable wall;
a trigger operatively connected to the energy generating mechanism; and
a generally cylindrical drum having an open, uncovered circumferential surface when mounted to the housing, the cylindrical drum having a longitudinal axis, and a plurality of spaced apart recesses in the circumferential surface, each recess extending parallel to the longitudinal axis and structured to receive and store a dart prior to launch, the dart having a deformable body, wherein each recess of the plurality of recesses is structured to leave a portion of the body of a received dart accessible, exposed and uncovered when the drum is mounted to the housing, and a plurality of protrusions, each protrusion mounted in a recess extending parallel to the longitudinal axis, wherein each protrusion is located and structured to help restrain the dart received by the recess, and each protrusion is covered by a dart loaded in the recess.

2. The apparatus as claimed in claim 1, wherein:
the energy generating mechanism is a pair of spinning wheels.

3. The apparatus as claimed in claim 1, wherein:
the energy generating mechanism is a stretchable string or cord.

4. The apparatus as claimed in claim 1, wherein:
each protrusion of the plurality of protrusions is mounted to a corresponding recess of the plurality of recesses.

5. The apparatus as claimed in claim 4, including:
a plurality of spikes mounted to and extending parallel to the longitudinal axis, each spike of the plurality of spikes being operatively aligned with a corresponding recess of the plurality of recesses.

6. The apparatus as claimed in claim 5, including:
a plurality of second protrusions, each of the second protrusions being mounted to a corresponding spike and being oppositely disposed from a corresponding protrusion of the first mentioned plurality of protrusions.

7. The apparatus as claimed in claim 1, including:
a platform mounted to the housing and positioned to engage a dart mounted to the drum when the dart is engaged by the energy generating mechanism.

8. A method for assembling a toy dart launch apparatus comprising the steps of:
forming a housing;
mounting an energy generating mechanism to the housing for engaging and causing the toy dart to discharge;
mounting a trigger to the housing;
connecting the trigger to the energy generating mechanism for activating the energy generating mechanism;
forming a generally cylindrical drum, the cylindrical drum having a circumferential surface, a longitudinal axis, a plurality of spaced apart recesses in the circumferential surface, and a plurality of protrusions, each recess extending parallel to the longitudinal axis and structured to receive and store a deformable dart prior to launch, each protrusion extending parallel to the longitudinal axis located and structured to help restrain the dart received by the recess the received dart covering the protrusion, and the circumferential surface between each of the recesses being clear of any structure; and
mounting the drum to the housing wherein the circumferential surface of the drum is uncovered and each recess of the plurality of recesses is structured to leave a portion of the dart uncovered.

9. The method as claimed in claim 8, including the step of:
locating a plurality of second protrusions on the drum, each second protrusion of the plurality of second protrusions located opposite a corresponding protrusion of the first mentioned plurality of protrusions.

10. The method as claimed in claim 9, including the step of:
mounting a spike to the drum parallel to the longitudinal axis of the drum and in alignment with a recess of the plurality of recesses.

11. The method as claimed in claim 8, including the step of:
mounting a platform to the housing to bear against a dart when the dart is engaged by the energy generating mechanism.

12. A dart magazine for a toy dart launch apparatus comprising:
a cylindrical housing having first and second ends, a circumferential surface and a longitudinal axis;
a support structure connected at the first end of the cylindrical housing;
a plurality of recesses formed in the circumferential surface of the cylindrical housing, each of the recesses extends parallel to the longitudinal axis from the support structure at the first end to the second end of the cylindrical housing, and each of the recesses includes a curved wall that in a section view disposed perpendicular to the longitudinal axis is a portion of a circle;

each recess of the plurality of recesses for receiving a cylindrical dart having a deformable wall, the wall having an outer surface exposed without any cover after the dart is received by a corresponding recess and until the dart is discharged from the dart launch apparatus;

the circumferential surface of the cylindrical housing between recesses being uncovered and clear of any structural element; and a plurality of protrusions extending parallel to the longitudinal axis of the cylindrical housing, each protrusion being mounted to the curved wall of a corresponding recess and being covered by a dart loaded in the recess, and each protrusion enabling the wall of a received dart to be deformed.

13. The dart magazine apparatus as claimed in claim 12, including:

a plurality of posts attached to the support structure at the first end of the cylindrical housing and extending parallel to the longitudinal axis of the cylindrical housing, each of the posts being spaced away from the curved wall of a corresponding recess and spaced away from the circumferential surface of the cylindrical housing.

14. The dart magazine apparatus as claimed in claim 13, including:

a plurality of second protrusions, each second protrusion being mounted to a post wherein the wall of the dart is received between the second protrusion on a post and the corresponding first mentioned protrusion on a corresponding recess curved wall, and each second protrusion being covered by a loaded dart.

15. The apparatus as claimed in claim 14, wherein:

each second protrusion is oppositely disposed from a corresponding protrusion of the first mentioned plurality of protrusions.

16. The apparatus as claimed in claim 15, including:

a platform mounted to the apparatus and positioned to engage a dart mounted to the drum at the time the dart is being launched from the drum.

17. The apparatus as claimed in claim 12, including:

a platform mounted to the apparatus and positioned to engage a dart mounted to the drum at the time the dart is being launched from the drum.

* * * * *